US008991349B2

(12) United States Patent
Manther et al.

(10) Patent No.: US 8,991,349 B2
(45) Date of Patent: Mar. 31, 2015

(54) INVOLUTE SPRING PALLET COMPONENT FOR A CYLINDER DEACTIVATION SWITCHABLE ROLLER FINGER FOLLOWER

(71) Applicant: Schaeffler Technologies AG & Co KG, Herzogenaurach (DE)

(72) Inventors: Debora Manther, Royal Oak, MI (US); Jeff Villemure, Beverly Hills, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 130 days.

(21) Appl. No.: 13/754,275

(22) Filed: Jan. 30, 2013

(65) Prior Publication Data

US 2013/0199480 A1 Aug. 8, 2013

Related U.S. Application Data

(60) Provisional application No. 61/594,789, filed on Feb. 3, 2012.

(51) Int. Cl.

| | |
|---|---|
| ***F01L 1/18*** | (2006.01) |
| ***B21K 1/20*** | (2006.01) |
| *F01L 13/00* | (2006.01) |

(52) U.S. Cl.

CPC . *F01L 1/18* (2013.01); *B21K 1/205* (2013.01); *F01L 13/0005* (2013.01); *F01L 13/0036* (2013.01); *F01L 2103/00* (2013.01); *F01L 2105/00* (2013.01)

USPC ..... 123/90.39; 123/90.16

(58) Field of Classification Search

USPC ..... 123/90.39, 90.16

See application file for complete search history.

(56) References Cited

U.S. PATENT DOCUMENTS

| | | | | |
|---|---|---|---|---|
| 7,250,070 | B2 | 7/2007 | Amano et al. | |
| 2008/0295789 | A1 | 12/2008 | Manther | |
| 2011/0126787 | A1 * | 6/2011 | Kirbach | 123/90.45 |

* cited by examiner

*Primary Examiner* — Zelalem Eshete

(74) *Attorney, Agent, or Firm* — Lucas & Mercanti, LLP

(57) ABSTRACT

A method of manufacturing spring pallets of a switchable roller finger follower. The method includes the steps of forming the spring pallets of the roller finger follower as a single unit, forming a material web between the spring pallets, and separating the spring pallets apart from each other. Also, an intermediate assembly of the spring pallets of the roller finger follower is disclosed. The intermediate assembly includes a first spring pallet, a second spring pallet, and a material web which extends between the spring pallets, and adjoins the spring pallets together. Further, a method of manufacturing an inner arm of the switchable roller finger follower is disclosed in which the inner arm is formed by sheet metal, preferably by stamping.

14 Claims, 5 Drawing Sheets

INVOLUTE SPRING PALLET COMPONENT FOR A CYLINDER DEACTIVATION SWITCHABLE ROLLER FINGER FOLLOWER

CROSS-REFERENCE TO RELATED APPLICATIONS

This application claims the priority of U.S. 61/594,789 filed Feb. 3, 2012, which is incorporated by reference herein.

FIELD OF INVENTION

The present invention relates generally to internal combustion engines and more particularly to a method of manufacture of components of a switchable roller finger follower and to an intermediate assembly of the switchable roller finger follower.

BACKGROUND OF THE INVENTION

Various methods of producing components for internal combustion engines are known. Some common methods of manufacturing components for internal combustion engines include forming the components individually by, for example, casting or forging. After forming, these components are typically then finished by machining before or after assembly. Alternatively, components for the internal combustion engine can be formed together and then separated by, for example, fracturing, sawing, or cutting. After the components are separated, any excess material can then be removed, and the surfaces connecting the components during forming are typically machined.

See, for example U.S. Pat. No. 7,250,070, which is directed to a method of forming a powder metal connecting rod that has a main body and a separable cap. The main body and cap are separated from each other by fracturing the main body and the cap. To fracture the main body and the cap, a tensile force is applied at a point of fracture between the main body and cap.

Also, see U.S. Patent Application No. 2008/0295789 for an example of a roller finger follower for valve deactivation.

SUMMARY OF THE INVENTION

In order to make performance improvements to an internal combustion engine, for example, to reduce fuel consumption, it is desirable to control valve opening events (e.g., cylinder deactivation). Also, for a valve train with a lever system cylinder deactivation, profile switching is accomplished by creating a lever that has lost motion capabilities.

The present invention is directed to a method of manufacturing spring pallets of a roller finger follower and a method of manufacturing an inner arm of a roller finger follower. The present invention is also directed to an intermediate assembly of the roller finger follower.

Spring pallets of a roller finger follower are typically manufactured with the inner arm of a roller finger follower. However, in the present invention the spring pallets are manufactured, for example by MIM or casting, separately from the inner arm. This allows for the inner arm to be manufactured as an individual sheet metal component and the spring pallets to be manufactured separately from the inner arm as a single spring pallet unit. Throughout the manufacturing process, the spring pallets are held together by a web of material. Prior to assembly, the spring pallet unit is separated into two spring pallets, which are mirror images of each other, and the spring pallets are assembled in the roller finger follower.

The manufacturing process of the present invention reduces the cost and time of manufacturing as the complexity of manufacturing the inner arm and the spring pallets is reduced. Moreover, the accuracy of the spring pallets is improved as the spring pallets are formed as mirror images of each other. Further, the manufacturing process allows for adjustment of the spring pallets in a roller finger follower assembly. Thus, by not fixing the spring pallets to the inner arm, the spring pallets can be placed in a more optimal position and orientation in the roller finger follower assembly.

Broadly, the present invention can be defined as a method for manufacturing spring pallets, of a switchable roller finger follower. The spring pallets comprise a first spring pallet, which has a first inner surface and a second spring pallet, which has a second inner surface. The method comprises the steps of forming the first spring pallet and the second spring pallet of the switchable roller finger follower as a single unit, forming a material web between the first spring pallet and the second spring pallet, and separating the first spring pallet from the second spring pallet.

The first spring pallet and the second spring pallet are manufactured by casting, forging or metal injection molding. There is an additional variation of this pallet, a universal fineblanked version, where there would be no mirror images.

The first spring pallet and the second spring pallet are mirror images of each other. Alternatively, the first spring pallet and the second spring pallet are manufactured by fineblanking manufacturing such that the first spring pallet and the second spring pallet are not mirror images of each other.

The spring pallets are separated by cracking, splitting, or cutting.

Also, the material web holding the first spring pallet and the second spring pallet together is a seam.

After being separated from each other, the spring pallets can be assembled with other components of the roller finger follower.

Additionally, the present invention broadly relates to an intermediate assembly of a roller finger follower. The intermediate assembly comprises a first spring pallet having a first inner surface, a second spring pallet having a second inner surface, and a material web extending between the first spring pallet and the second spring pallet. The material web adjoins the first spring pallet and the second spring pallet together.

The spring pallets are manufactured by casting, forging or metal injection molding.

The first spring pallet and the second spring pallet are mirror images of each other. Alternatively, the first spring pallet and the second spring pallet are not mirror images of each other.

The material web holding the first spring pallet and the second spring pallet together is a seam.

Further, the present invention broadly relates to a method for manufacturing an inner arm of a roller finger follower, which comprises the step of forming the inner arm as a sheet metal component. The inner arm can be formed, for example, by stamping.

BRIEF DESCRIPTION OF THE DRAWINGS

The present invention will be further understood and appreciated by reading the following description in conjunction with the accompanying drawings, in which.

DETAILED DESCRIPTION OF THE INVENTION

Figure 1:
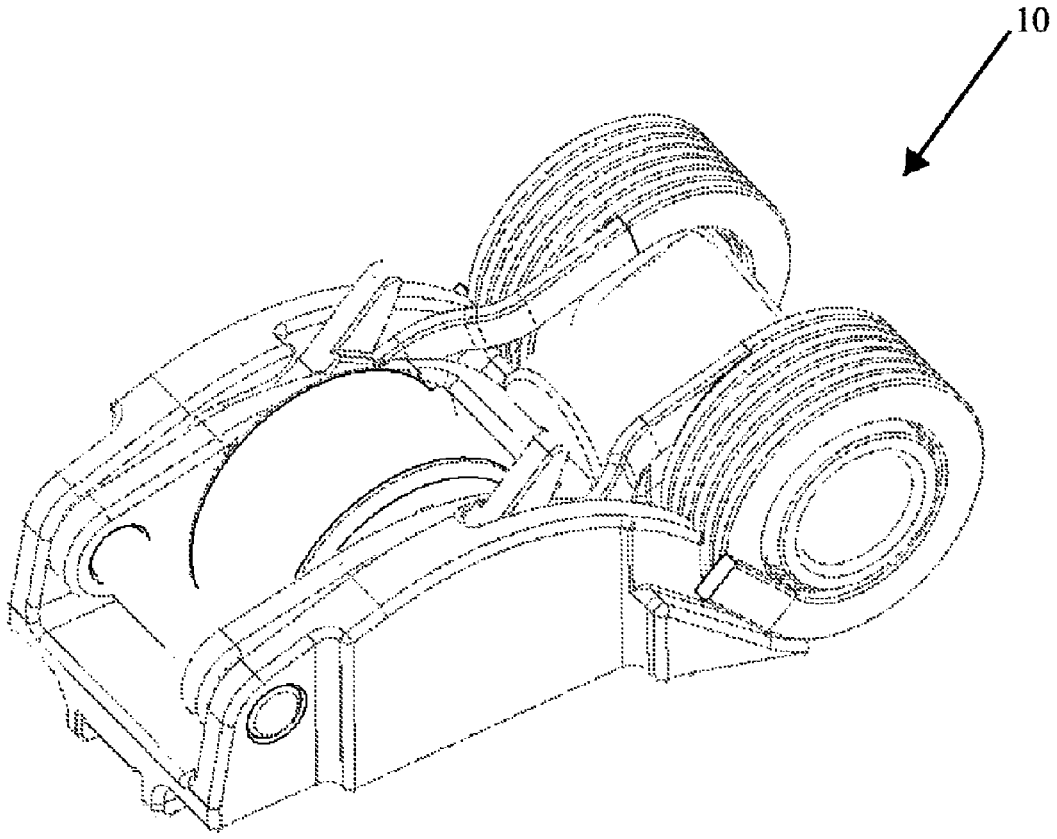
FIG. 1 is perspective view of a roller finger follower.
Figure 2:
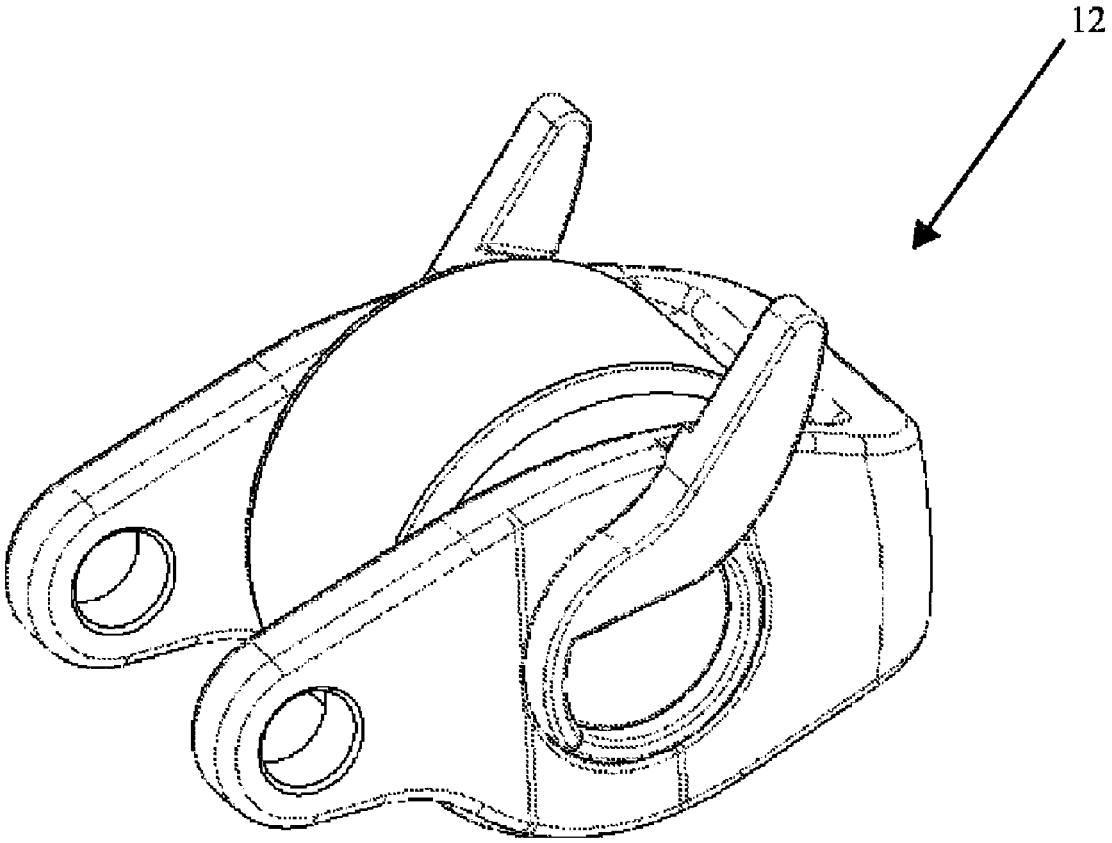
FIG. 2 is a perspective view of an inner arm assembly of the present invention.

FIG. 1 illustrates a perspective view of a roller finger follower 100 FIG. 2 illustrates an inner assembly 12 of the roller finger follower 10. The inner assembly 12 includes an inner arm 14 and a first spring pallet 16 and a second spring pallet 18 mounted on the inner arm 14.

Figure 3:
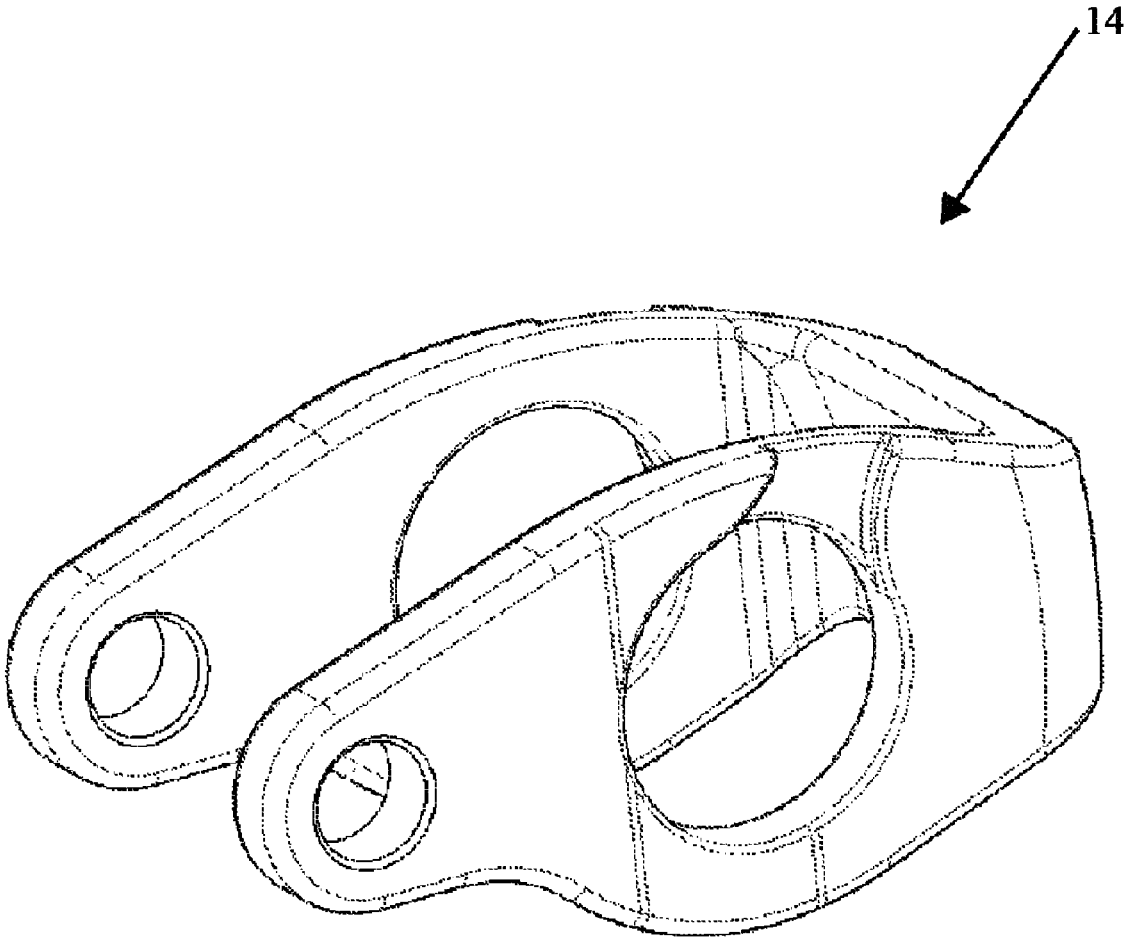
FIG. 3 is a perspective view of a an inner arm of the present invention.

FIG. 3 illustrates a perspective view of the inner arm 14. The inner arm 14 is preferably manufactured as a sheet metal component that is stamped. However, any other known material or method of forming the inner arm 14, such as forging or casting, can also be used.

Figure 4:
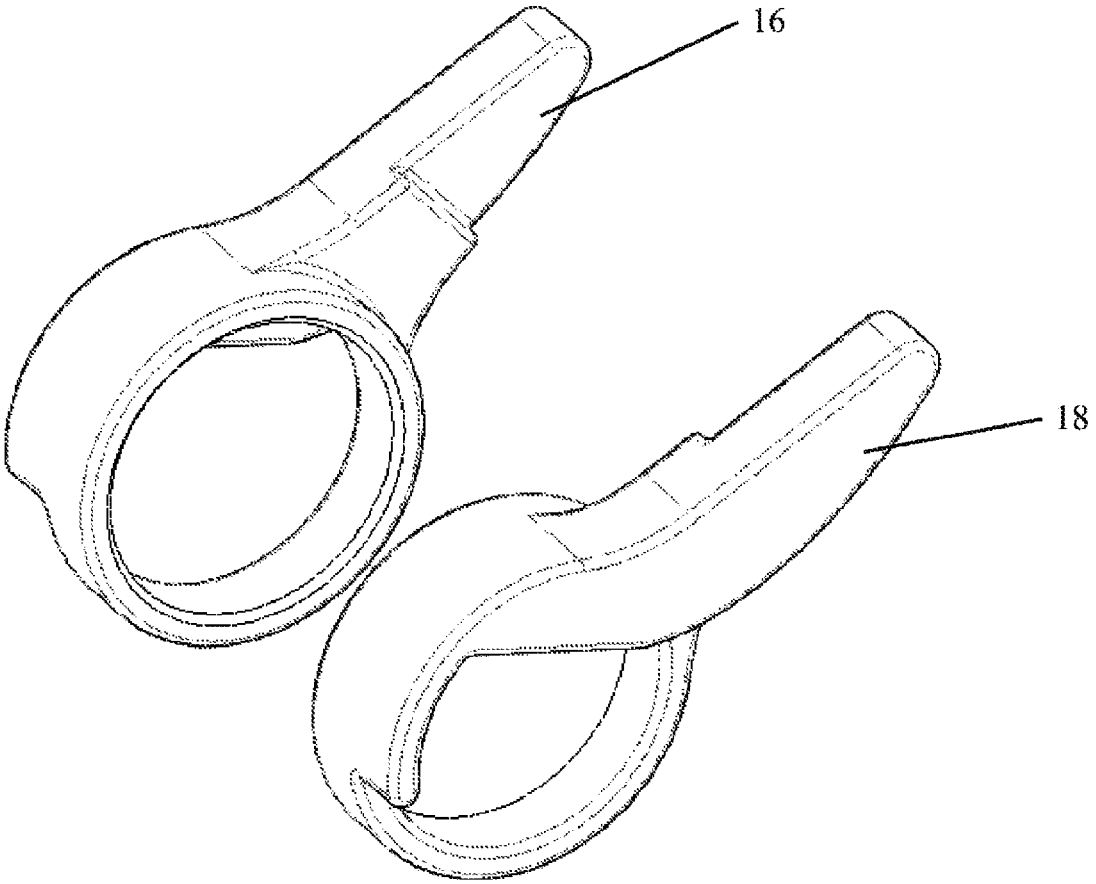
FIG. 4 is a perspective view of spring pallets of the present invention.

FIG. 4 illustrates perspective views of the spring pallets 16, 18. The spring pallets 16, 18 are mirror images of each other.

Figure 5:
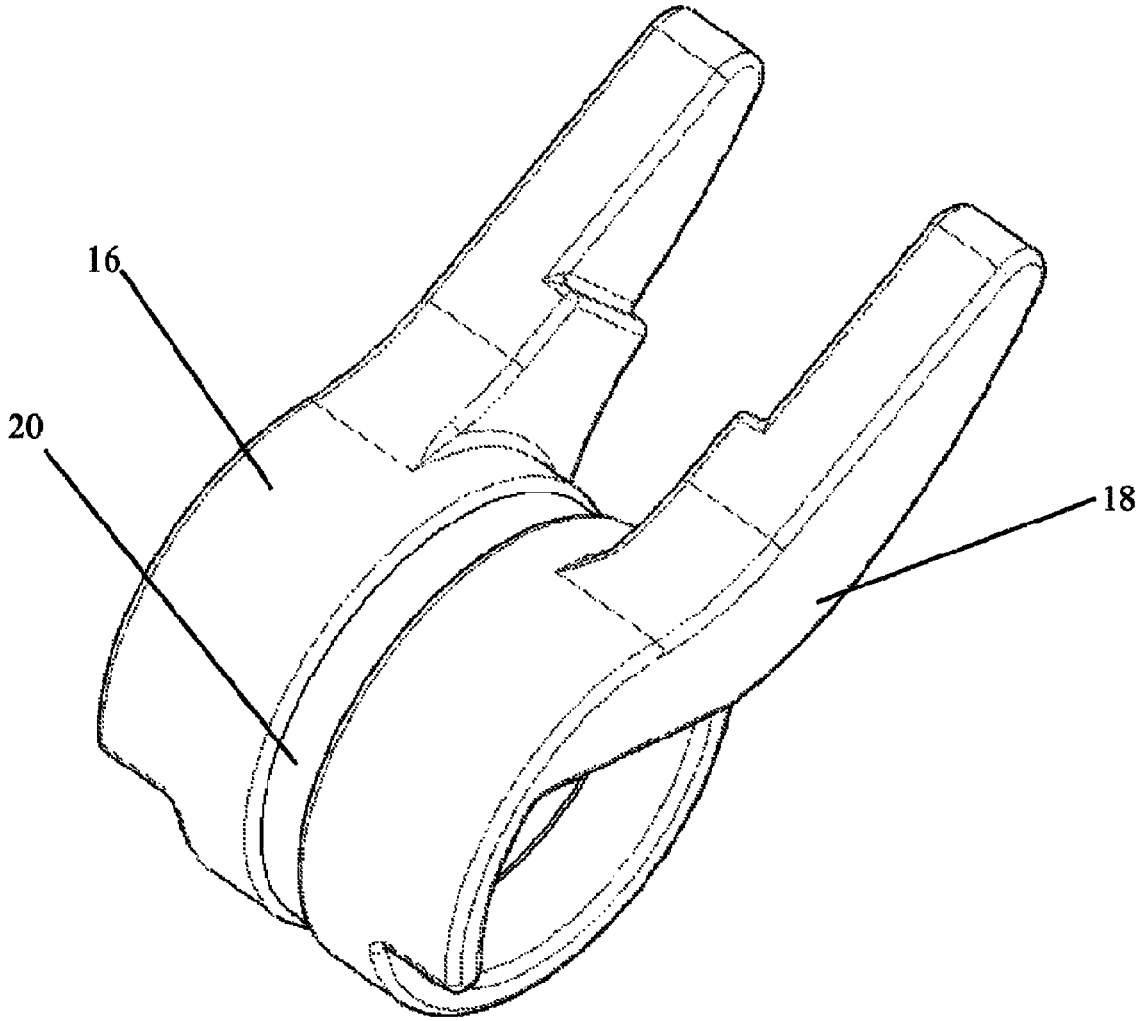
FIG. 5 is a perspective view of a spring pallet unit.

As shown in FIG. 5, the spring pallets 16, 18 are formed from a spring pallet 20 unit which comprises a first spring pallet 16, a second spring pallet 18 and a seam or web of material 22, which holds the first spring pallet 16 and the second spring pallet 18 together. The web is formed between the first spring pallet 16 and the second spring pallet 18. Preferably, the spring pallet unit is cast, forged or metal injection molded as a single unit. However, any other known method of manufacturing the spring pallet unit can also be used. After the spring pallet unit is manufactured, the spring pallets 16, 18 are then separated from each other. Preferably, the spring pallet unit is cut in half to separate the spring pallets 16, 18 from each other. However, any other known method of separating the spring pallets 16, 18 can also be used, including but not limited to fracturing, sawing, or cutting.

By manufacturing the spring pallets 16, 18 as a single spring pallet unit, the cost of manufacturing and the volume of manufacturing the spring pallets 16, 18 and the inner arm 14 are significantly reduced. Also, the spring pallets 16, 18 are more accurately manufactured.

The present invention has been described with reference to a preferred embodiment. It should be understood that the scope of the present invention is defined by the claims and is not intended to be limited to the specific embodiment disclosed herein.

LIST OF REFERENCE NUMERALS

10 Roller Finger Follower
12 Inner Assembly
14 Inner Arm
16 First Spring Pallet
18 Second Spring Pallet
20 Spring Pallet Unit
22 Seam, Web, Material

What is claimed:

1. An intermediate assembly of a roller finger follower, comprising:

a first spring pallet having a first inner surface;

a second spring pallet having a second inner surface; and a material web extending between the first spring pallet and the second spring pallet, adjoining the first spring pallet and the second spring pallet together;

the first spring pallet and the second spring pallet are separable and are each adapted for separate assembly onto a discrete arm of the roller finger follower.

2. A method for manufacturing spring pallets, which comprise a first spring pallet having a first inner surface and a second spring pallet having a second inner surface, for a roller finger follower, the method comprising the following steps:

forming an intermediate assembly of claim 1 including the first spring pallet and the second spring pallet as a single unit;

forming a material web of the intermediate assembly between the first spring pallet and the second spring pallet; and separating the first spring pallet from the second spring pallet.

3. The method of claim 2, wherein the first spring pallet and the second spring pallet are separated by cracking, splitting, or cutting.

4. The method of claim 2, wherein the first spring pallet and the second spring pallet are mirror images of each other.

5. The method of claim 2, wherein the first spring pallet and the second spring pallet are manufactured by fineblanking manufacturing such that the first spring pallet and the second spring pallet are not mirror images of each other.

6. The method of claim 2, wherein the first spring pallet and the second spring pallet are manufactured by casting, forging or metal injection molding.

7. The method of claim 2, further comprising the step of assembling the first spring pallet and the second spring pallet with other components of the roller finger follower after the first spring pallet and the second spring pallet are separated from each other.

8. The method of claim 2, wherein the material web holding the first spring pallet and the second spring pallet together is a seam of material.

9. The intermediate assembly of claim 1, wherein the first spring pallet and the second spring pallet are manufactured by casting, forging or metal injection molding.

10. The intermediate assembly of claim 1, wherein the first spring pallet and the second spring pallet are mirror images of each other.

11. The intermediate assembly of claim 1, wherein the first spring pallet and the second spring pallet are not mirror images of each other.

12. The intermediate assembly of claim 1, wherein the material web holding the first spring pallet and the second spring pallet together is a seam of material.

13. A method for manufacturing an inner arm of a roller finger follower, comprising the following steps:

forming the inner arm as a sheet metal component;

forming an intermediate assembly an intermediate assembly of claim 8 including the first spring pallet and the second spring pallet as a single unit;

forming a material web of the intermediate assembly between the first spring pallet and the second spring pallet; and separating the first spring pallet from the second spring pallet.

14. The method of claim 13, wherein the inner arm is formed by stamping.

* * * * *